US005551583A

United States Patent [19]

Sachathamakul et al.

[11] Patent Number: 5,551,583

[45] Date of Patent: Sep. 3, 1996

[54] ADJUSTABLE ORIENTATION DEVICE FOR CONNECTING A NIPPLE TO A BABY BOTTLE

[75] Inventors: Rakeshwar Sachathamakul; Gurpinder Duggal, both of Bangkok, Thailand

[73] Assignee: Mother's Love Pte. Ltd., Singapore

[21] Appl. No.: 293,475

[22] Filed: Aug. 22, 1994

[51] Int. Cl.[6] ..... A61J 9/00; A61J 11/04; A61J 15/00

[52] U.S. Cl. ..... 215/386; 215/11.1; 215/388

[58] Field of Search ..... 220/666; 215/1 A, 215/100 R, 11.1, 386–388

[56] References Cited

U.S. PATENT DOCUMENTS

| | | | |
|---|---|---|---|
| 2,812,764 | 11/1957 | Crisp | 215/11.1 |
| 2,843,281 | 7/1958 | Gallois | 215/11.1 |
| 4,153,170 | 5/1979 | Aquarian | 215/1 A X |
| 4,153,172 | 5/1979 | Bialobrzeski | 220/666 X |
| 4,583,668 | 4/1986 | Maynard, Jr. | 220/287 X |
| 4,813,556 | 3/1989 | Lawrence | 215/11.1 X |
| 4,921,147 | 5/1990 | Poirier | 220/666 X |
| 5,002,193 | 3/1991 | Touzani | 220/666 X |
| 5,105,956 | 4/1992 | Trang-Lin | 215/11.1 |
| 5,190,174 | 3/1993 | Klag | 215/11.1 |

FOREIGN PATENT DOCUMENTS

| | | | |
|---|---|---|---|
| 1600773 | 10/1990 | U.S.S.R. | 215/11.1 |
| 2067416 | 7/1981 | United Kingdom | 215/11.4 |
| 2109247 | 6/1983 | United Kingdom | 215/11.6 |
| 2208291 | 3/1989 | United Kingdom | 215/11.1 |

*Primary Examiner*—Sue A. Weaver
*Attorney, Agent, or Firm*—McAulay Fisher Nissen Goldberg & Kiel, LLP

[57] ABSTRACT

An adjustable orientation device for a baby bottle to change the angular relationship between an exit area of the bottle and an exit from an exit orifice coupled with the exit area of the bottle, including a bellows-type structure having an entrance and an exit axially aligned in one condition thereof, the bellows-type structure including at least one bellow member, an interlocking mechanism for locking the bellows-type structure in different angular relationships between the exit orifice and the exit area, the interlocking mechanism being connected to the at least one bellow member and being sufficiently resilient to remain in any one of a plurality of pre-selected positions and being compressible to a minimum length condition and extendable to a maximum length condition by compressing the at least one bellow member and locking it to the interlocking mechanism, and the bellows-type structure being bendable so that the exit and the entrance are no longer axially aligned.

10 Claims, 4 Drawing Sheets

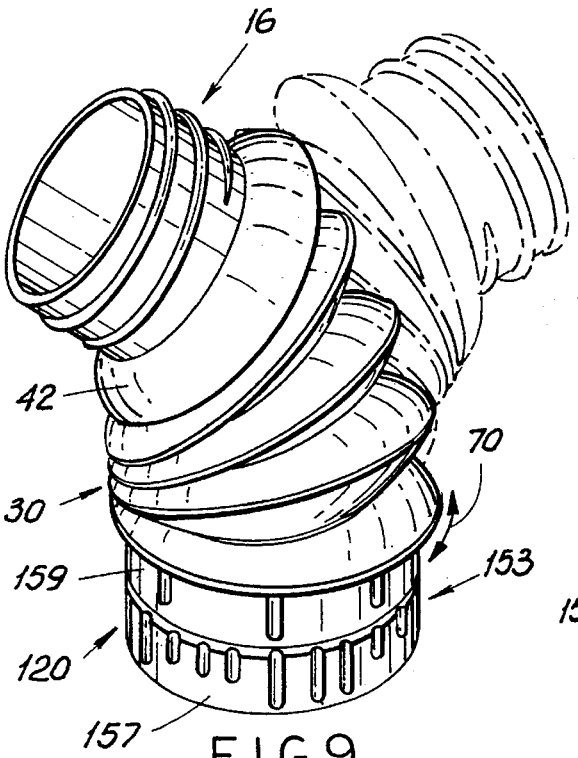
FIG.9
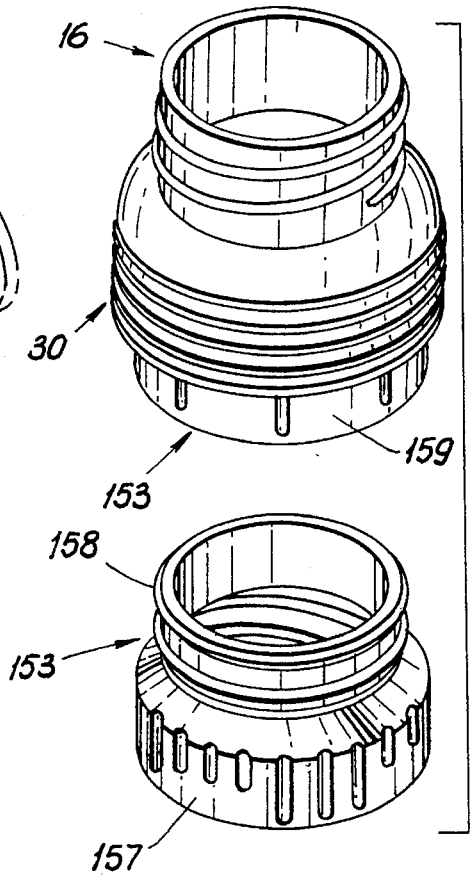
FIG.11
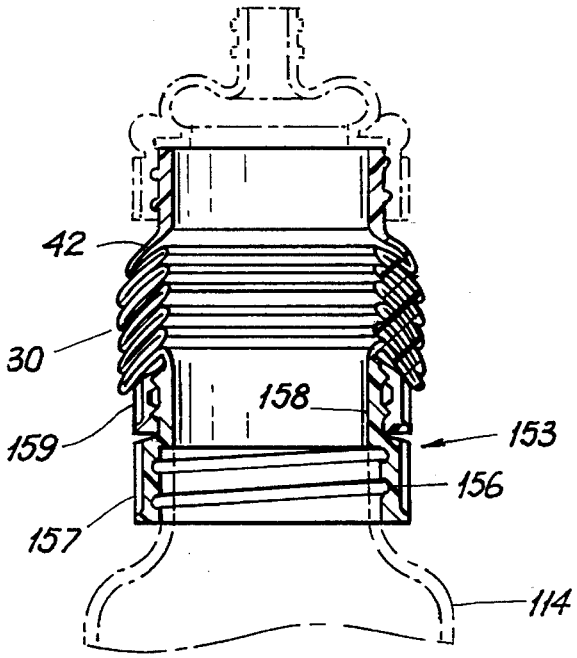
FIG.10
FIG.12
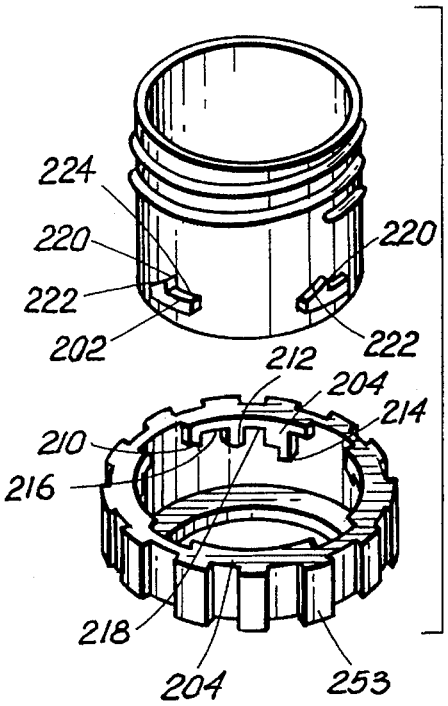

ADJUSTABLE ORIENTATION DEVICE FOR CONNECTING A NIPPLE TO A BABY BOTTLE

BACKGROUND OF THE INVENTION

1. Field of the Invention

This invention relates to an adjustable orientation device for a baby bottle used for feeding an infant as well as others who may require feeding by means of a bottle containing nutriments.

More particularly, the invention is concerned with the adjustable orientation device which serves as an accessory or attachment for a feeding device to provide for the freedom to position a self-contained feeder in various different positions together with the capability of locking the adjustable orientation device into different positions. The adjustable orientation device is used to connect a conventional baby bottle to a conventional nipple.

2. Description of the Prior Art

Various attempts have been made heretofore to provide for a baby bottle nurser which is adapted to move with the baby movements of an infant while nursing. When an infant is nursed artificially, different types of infant positions are attempted to be achieved to provide comfort as well as to simulate as closely as possible the nursing activity of an infant as if it were nursing from its mother's breast. Heretofore, attempts have been made, but the prior art attempts generally result in a closure or curtailment of the flow of the liquid because of a constriction of the liquid flow path.

U.S. Pat. No. 4,813,556 to Lawrence discloses a baby bottle having a bellows which is bendable and capable of being loaded into place either on one side position or in a compressed position of the bellows.

This disclosure provides for what appears to be a bellows-type construction in which the individual bellows members each comprise first and second interconnected members. The size and slope of each of the first and second interconnected members are different from each other. The interconnection element connecting the first and second members is of a different size from the first and second interconnected members, and has a thickness less than the thickness of the two differently sloping members. The steeper and shorter slope member locks beneath the gentle and longer sloping member.

Klag, U.S. Pat. No. 5,190,174 is concerned with an infant feeding bottle having a rubber or plastic nipple which is provided with a flexible positioner located between the nipple portion and the bottle itself. While the nipple is provided with corrugations to provide for flexibility, it is well known that the nipple portion is the weakest link of the baby nurser and requires frequent replacement due to its loss of flexibility and thereby resulting in a collapsing of the nipple. Also, the requirements of the flexible corrugated portion is different from that of the nipple portion and, therefore, requiring excessive costly nipples. The Klag nipple requires different types of material density so that the cost of manufacture is thereby increased.

Kesselring, U.S. Pat. No. 4,505,398, is concerned with a nipple which has an accordion-like wall portion which has a zig-zag shaped profile.

Pancoast, U.S. Pat. No. 2,709,434, discloses a nipple which has areas of weakness to bend out of vertical alignment. The areas of weakness eventually results in failure of the nipple due to the area of weakness.

Crisp, U.S. Pat. No. 2,812,764, discloses a nipple which is permanently set at an angles displaced from the longitudinal axes of the bottle.

OBJECTS AND ADVANTAGES OF THE INVENTION

One of the objects of the present invention is to provide an attachment for a baby feeder or bottle which will permit flexing, tilting or movement of the feeder through any angle for positioning the feeder in a position suitable for an infant or another to be fed.

A feature of the invention is the provision of a baby feeder with an adjustable orientation device to provide for easy flow of the contents in a baby nurser or other feeder so as to minimize intake of air bubbles which can cause a colic condition or other form of discomfort in an infant or another fed from the baby nurser or other feeder.

A further object of the invention is to provide an attachment with a swivel connector so that the nipple will have a 360° freedom of movement thereby providing an adjustable orientation device to enable the infant to secure the nipple in its mouth even though the infant may be moving its face around.

Another object of the invention is to provide a bellows-type of unit which includes one or more individual bellow units in which each bellow unit includes a V-shaped unit having two equal and identical legs which are interconnected at a vertex or apex, and the free ends of the two identical legs can be joined and are joined during construction to an adjacent bellow unit so that a concertina-type of extension is produced. To lock the bellows-type unit in a particular position, a special locking means is provided in which the locking means includes a pair of members, one of which is substantially equivalent to each of the two identical legs but having an outer extremity which is narrower than the outer extremity of the apex joining the two identical legs.

The locking means also preferably includes a roof member forming one of the pair of members, and the other member of the pair of members includes an under-roof member which is substantially equivalent to each of the two legs and having its outer extremity narrower than the outer extremity of the apex joining the two legs.

With the present invention substantially complete freedom of movement of the baby feeder relative to an individual such as an infant's face, as well as complete freedom of movement of the feeder relative to an individual's face and torso is permitted.

A feature of the invention is the provision of flexible bellows or concertina-type of movable members which can be made from any conventional material such as polyethylene or equivalent non-toxic and unbreakable plastic material or a suitable elastomer such as rubber or a rubber substitute having some rigidity and which can be hygienically sterilized after each use, or any other material having comparable properties.

The flexible bellows or concertina-type of movable members together with a unique roof portion of the present invention is usable with any and all conventional nipple and baby bottles or containers, so that one need not dispose of the nipples or bottles one already possess. Moreover, there are different types of conventional nipples made for different purposes, and such nipples may still be used with this invention.

The orientation device according to the invention includes at least one bellow member, an arcuate roof portion in the preferred embodiment connected with a half portion of a bellow member, which half portion of the bellow member is connected with at least one bellow member to provide for a locking of the orientation device. In addition to the preferred locking means of the roof portion, the outer extremity of the roof portion has a perimeter which is less than the outer perimeter of the individual bellow unit to which it is connected, and is less than the outer perimeter of the other individual bellow units.

While the invention is primarily intended for a baby nurser, it will be obvious to those skilled in the art that the flexible bellows can also be used with adult feeding devices which require the use of a nipple or similar mechanism.

With the present invention, it is possible to lock the nipple to the bottle by means of the roof portion and the half portion of a bellow member connected thereto so that the axes of the nipple and the axis of the bottle can coincide or not coincide, depending upon the requirements of the user as well as the infant or other using the bottle with the attachment as a feeding device.

Another feature of the invention is to provide a swivel type of connector .for connecting the flexible bellows-type orientation device to the baby nurser and the nipple. This will permit various orientations relative to the infant nurser.

The orientation device, which is adapted to be connected to a feeder bottle with a swivel connector, and the bellows-type connector, will flex to any degree of angle suitable to the position of the infant during nursing. The flexibility is achieved, as noted, by using any plastic base flexible material which is non-toxic and adapted to permit the flow of any fluid, hot or cold, up to a certain temperature used for feeding or sterilizing.

The angle, while providing an easy flow, tends to minimize the intake of air bubbles which result in a colic condition.

The utility for the swivel attachment enables the nipple part, as well as the liquid container, to rotate through an angle of 360°. The rotary movement enables the infant to secure the nipple in its mouth, despite turning its face around or being displaced from its original feeding position.

A further feature is to provide a rapid connect and disconnect mechanism for connecting the attachment with the baby bottle or container and the nipple.

BRIEF DESCRIPTION OF THE DRAWINGS

FIG. 9 is a view similar to FIG. 6, showing another modification of the adjustable orientation device according to the invention showing a swivel attachment mechanism at the end of the bellows-type unit for connection to the mouth or exit end of the baby bottle employing the roof portion of the FIG. 3 modification also showing two of its many possible orientations as in FIG. 6 and having the swivel connector mechanism coupled with a female-type connector for connection to the male-type screw connector of the exit end of the baby bottle for connection to the conventional baby bottle;

FIG. 10 is a sectional view of the bellows-type unit of the FIG. 9 modification shown in its collapsed or compressed condition and locked in its completely compressed condition and showing the roof portion connected with a plurality of individual bellow units and the swivel connector at the extreme end;

FIG. 11 is an exploded perspective view of the FIG. 7 embodiment with the bellows-type units connected to one portion of the part of the swivel unit separated from the other part of the swivel unit; and FIG. 12 shows a modified connector in lieu of a screw type connector to provide for a quick connection and quick release.

DESCRIPTION OF THE PREFERRED EMBODIMENTS

Figure 1:
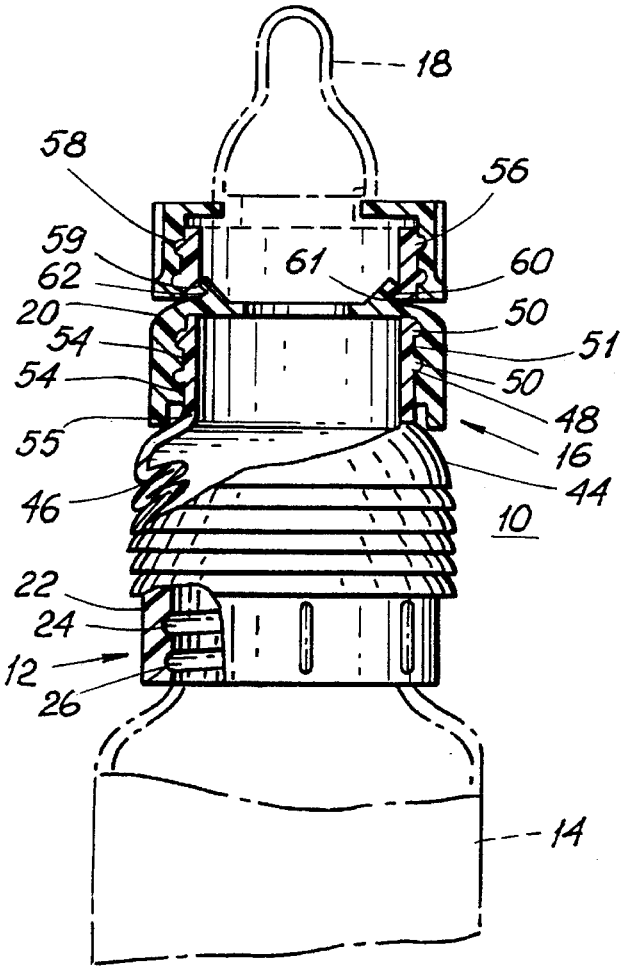
FIG. 1 illustrates a conventional baby bottle and nipple or teat with an adjustable orientation device according to the invention including a flexible bellows-type unit having a swivel connector at the end associated with the nipple according to one embodiment for connecting a conventional nipple or teat to the baby bottle.

Referring now more particularly to FIGS. 1 to 8 of the accompanying drawings, one embodiment of the adjustable orientation device 10 is shown having its entrance end 12 coupled with a conventional liquid container or bottle 14 shown in dashed outline, and its other end or exit end 16 coupled with a conventional nipple 18 shown in dashed outline.

The orientation device in this embodiment includes a swivel connector mechanism 20 at its exit end 16, a conventional connector 22 having internal female screw threads 24 for connection with the male screw threads 26 at the mouth of bottle 14. Coupled with swivel connector mechanism 20 and connector 22 is a bellows-type unit 30.

Figure 5:
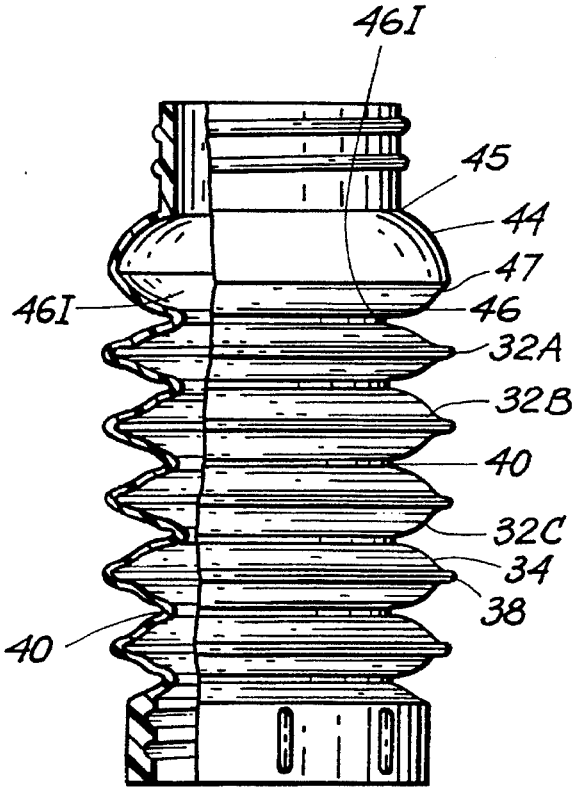
FIG. 5 is a partial sectional view of the bellows-type unit of FIG. 3 shown in its extended condition with the roof portion connected with the exit end and a plurality of individual bellow units, one of which is connected with an entrance end, and the portion including an under portion connected with one of the plurality of individual bellow units.
Figure 4:
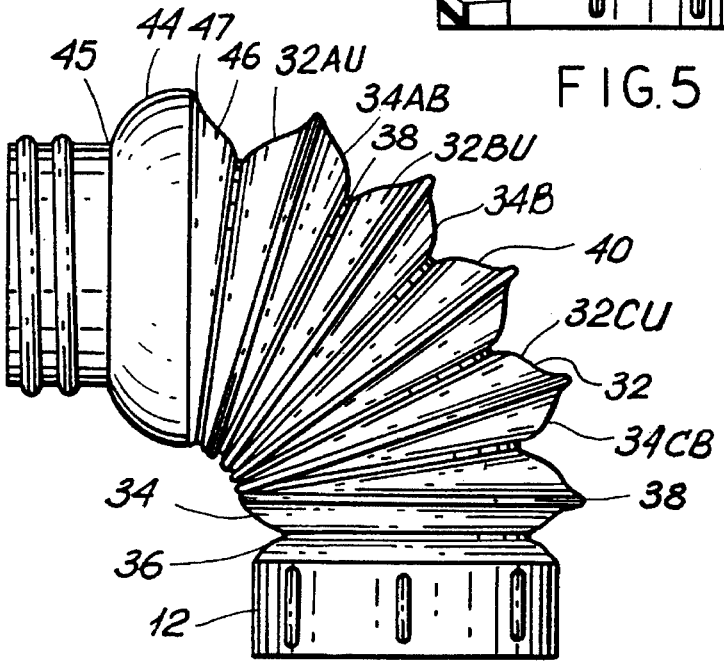
FIG. 4 is a perspective view of the bellows unit shown in full outline tilted or bent toward the left side of the drawing and shown in its locked condition, and shown with the axis of the entrance end substantially orthogonal to the axis of the exit end.
Figure 6:
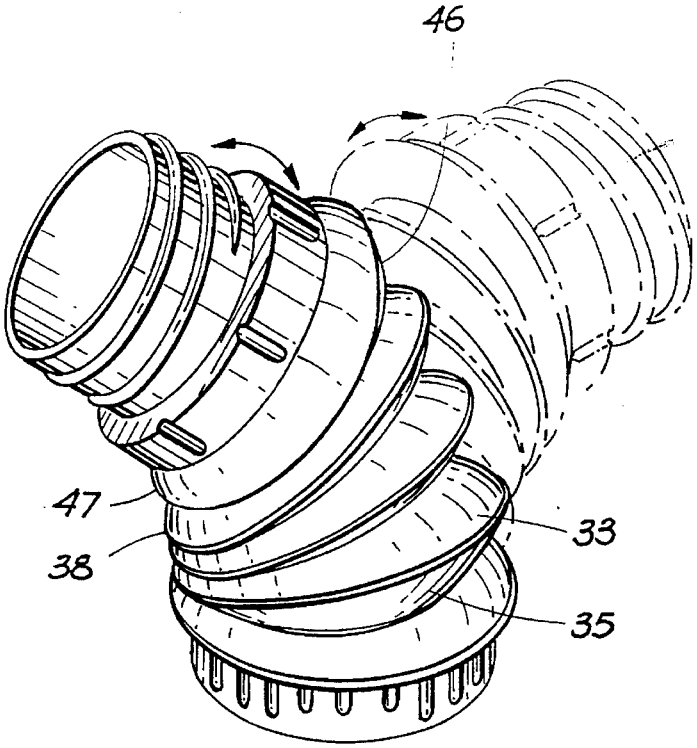
FIG. 6 shows a flexible bellows-type attachment together with the swivel connector connected to the roof according to the invention with the attachment tilted or bent towards the left side of the drawing shown in full outline and bent towards the right side of the drawing shown in dotted outline, and one end or the exit end having the swivel connector including a male end screw-type connector for receiving a conventional female screw-type cap connector for connecting thereto the nipple, and the other side having a female connector for connecting the attachment to the conventional baby bottle at the outlet mouth thereof.

Bellows-type unit 30, as best seen in FIGS. 4 and 5, includes at least one and preferably a plurality of individual bellow-units 32A, 32B, 32C, etc., one of which individual bellow units is connected with connector 22. Each of the individual bellow units includes a pair of upper and lower substantially flat planar members 32, 34 having a substantially circular configuration, as shown, in a flat plane projection and provided with an outer diametrical extent and joined together at a vertex or an apex 38, and an inner diametrical extent 40 of the central opening. Members 32, 34 each have a partially curved surface in a collapsed condition or retracted condition of the bellows.

Each of the members 32 and 34 are preferably equal or substantially identical to each other and, in a collapsed condition of the bellows-type unit, they would effectively overlie one another. In the collapsed condition, upper planar member 32 has a partially arcuate configuration or slightly curved outer upper surface and lower planar member 34 also in the collapsed condition has a slightly upwardly curved outer surface which substantially fits with and extends coextensively with and under upper planar member 32. In the extended or expanded condition, each member 32, 34 would extend at an equal angle from a horizontal plane orthogonal to the longitudinal axis of the bellows unit, when the bellows unit is not bent or tilted. On the other hand, as will be further explained, when the exit end and entrance end of the bellows-type unit 30 are not axially aligned, then each of the sides 32, 34 will assume different positions.

While the bellows-type structure is shown and described as cylindrical and having a circular cross-section orthogonal to the longitudinal axis, it is within the scope of the invention to have a cross-section which varies from the circular dimension and the bellows-type structure can be considered to be substantially cylindrical.

Figure 3:
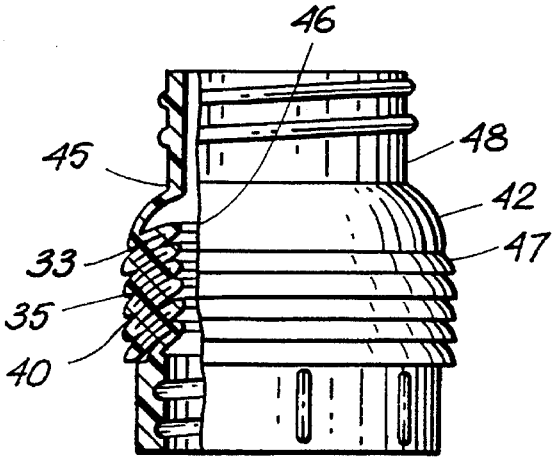
FIG. 3 is a partial sectioned view of the bellows unit of FIG. 2 in its collapsed condition showing a preferred upper roof side portion of the connection to the individual bellow units.

If the upper and lower planar members 32, 34, respectively, are not provided with an inner edge and an outer edge having a flat circular projection, but some other configurations with an oval-shaped outer periphery and an oval or different-shaped inner periphery, each of the elements can be defined as a surround member, and each surround member 33, 35, as viewed in FIG. 3, is of the same configuration and having the same thickness.

The connection from the bellows-type unit 30 to the entrance end is by means of a different type of planar member 36 which is sized to have an outer dimension to mate with entrance end 12 and an inner dimension to mate with the inner periphery of the planar member or surround. Planar member 36 can be further defined as an entrance end planar member 36.

If a surround type of member such as 33, 35 is used for 32 and 34, they still would be identical to each other as if they had been stamped out individually with the same stamping die plate.

As viewed in FIGS. 4 and 5, each bellow unit includes an upper wall 32AU, 32BU and 32CU, etc. defined by planar member 32 and a bottom or lower wall 34AB, 34BB and 34CB, etc. defined by planar member 34. When more than one bellow unit is used to form the bellows type unit 30, the lower wall 32AB of the one bellow unit 32A is joined to the upper wall 32BU of the next adjacent bellow unit 32B at the inner diametrical extent 40. Each bellow unit includes two of the planar members 32, 34 joined to each other at outer diametrical edge member or apex 38. As shown in the drawings, 38 and 40 represent two concentric circles to define the perimeteral extent of the planar members 32 and 34.

Figure 8:
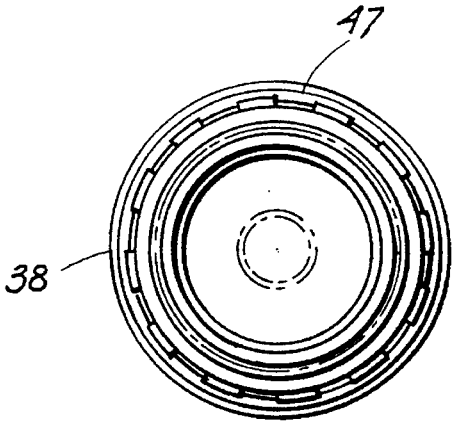
FIG. 8 is a plan view of FIG. 7 looking down from the top towards the nipple, and showing the relative relationship of the roof portion and the individual bellow units.
Figure 7:
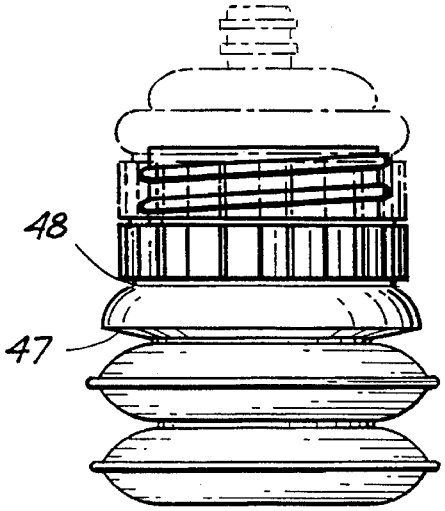
FIG. 7 is a view somewhat similar to that of FIG. 1, showing a different type of nipple, and showing part of the bellows unit in its expanded condition and showing details of the roof portion and the individual bellow units connected with the roof portion.

Bellows type unit 30 also includes a roof unit 42 including a first or roof portion 44 and a second or an under-roof portion 46. Under-roof portion 46 has a substantially planar surface with an inner circumferential opening 46I which is the same as the inner circumferential opening 40 of the individual bellows unit. The outer circumference of under-roof portion 46 is 47, as seen in FIG. 8 and the diametrical extent of under-roof portion 46 is less than the outer diametrical extent of apex 38.

Under-roof portion 46 is substantially equivalent to and the same as planar members 32, 34 in flat plane projection, but it has an outer diametrical and peripheral extent which is less than the outer peripheral and diametrical extent of 38.

Roof portion 44 has an arcuate outer surface and extends between 47 at its largest diametrical extent and merges with or is connected with extension 48 forming part of the swivel connector at the exit end 16.

When the bellows type unit 30 is moved to lock a bellow-unit under roof unit 42, locking takes place as a result of the bellow unit 32A, the first full bellow unit adjacent to roof unit 42, snapping into place under the under-roof portion 46 with the outer edge of apex 38 extending beyond the outer edge 47 of the roof portion 44.

The lower planar or side member 34 fits underneath the upper planar or side member 32 when said at least one bellow member is collapsed, and the upper and lower side members are snappably related so that movement of the upper and lower side members together causes the lower side member and the upper side member to snap together to maintain the axial orientation of two adjacent inner circular members coaxial, when one of the upper side members is locked to the locking means.

The outer diametrical extent or perimeter of roof portion 44 does not cover or extend as far out as the outer edge of apex 38 which is the continuous outer peripheral edge of planar members 32, 34 or surrounds 33, 35.

In order for the bellows type unit to be locked into place, the bellow unit 32A adjacent to roof unit 42 must be locked thereto. The other bellow-units 32B, 32C, etc., can be snapped into place relative to each other in order to reduce the longitudinal extent or to impart a curvature or arcuate formation so that the exit end 16 and entrance end 12 are not coaxial, but the amount of force necessary to reduce or increase the spacing between units 32B and 32C, etc., is less than the amount of force required to separate or to lock together bellow unit 32A and roof unit 42. In order to achieve locking of the bellow unit 32A to roof unit 42, the upper roof portion 44 has to be curved between its outer connection to the under-roof portion 46 and its inner peripheral or diametrical connection to the periphery of the exit end 16.

Unless the roof unit 42 comprising roof portion 44 and under-roof portion 46 are locked into place, the bellows-type unit is not tightly locked into place and the other individual bellow units are easily separated and moved to a different orientation during use.

The upper portion of roof unit 42 forming roof portion 44 has a partially torroidally-shaped surface. The outer surface of roof portion 44 forms about one-quarter of a complete torroidally-shaped surface in order to achieve a locking action which is different and firmer than the locking action of adjacent bellow units such as bellow units 32B and 32C or bellow units 32B and 32A.

Roof portion 44 has a curved surface connecting its inner diametrical extent 45 to exit extension 48 and its outer diametrical extent 47 to under-roof portion 46. While under-roof portion 46 and surround member 33 and 35 can have substantially the same configuration, the outer apex 38 has a larger diametrical or wider extent than the diametrical or widest extent of apex 47 joining upper roof portion 44 and under-roof portion 46.

Swivel connector mechanism 20 generally includes an exit cylindrical portion formed by exit extension 48 and having a pair of outer raised circumferential bands 50, 50 with a lower surface 51 therebetween so that bands 50, 50 together with lower surface 51 form a generally U-shaped outer configuration on extension 48. A cap 53 is provided having on the interior thereof bands 54,54, one of which fits between bands 50, 50 and the other of which fits under the lower band 50 and abuts the outer wall 55 of exit extension 48.

Figure 2:
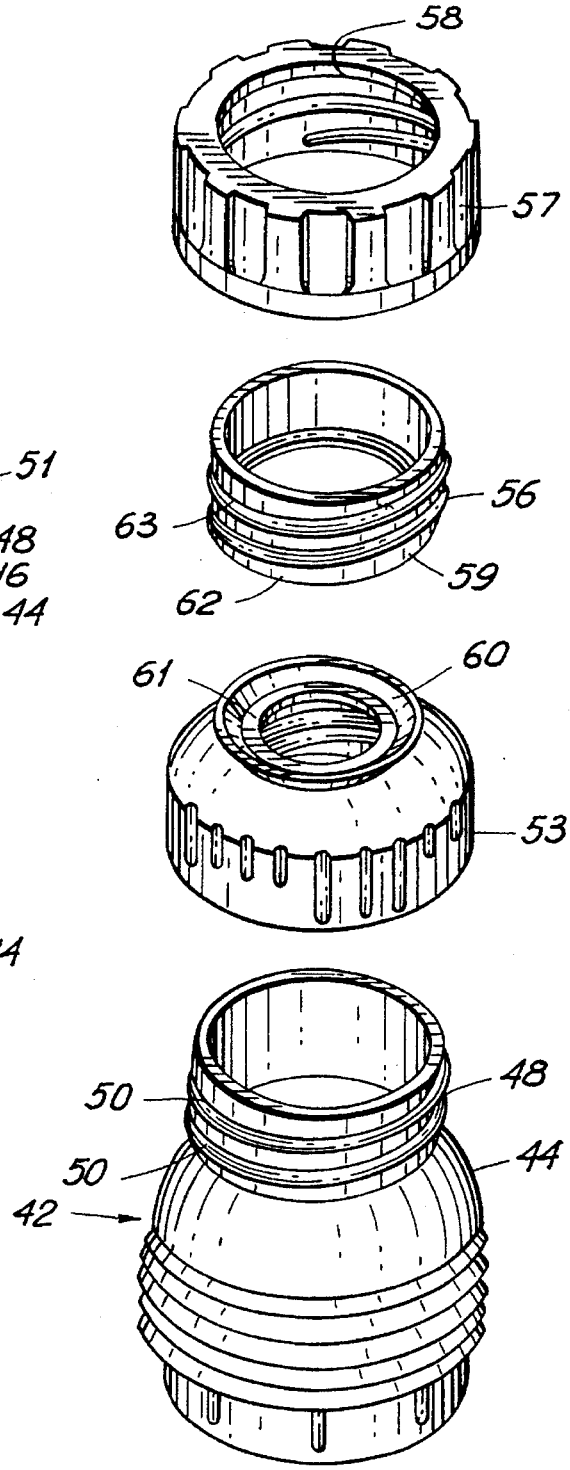
FIG. 2 is an exploded view of the bellows-type attachment together with the component elements of the swivel connector of the FIG. 1 embodiment.

Cap 53 is shown separate from outer threaded portion 56. Cap 53 can be manufactured with threaded portion 56 as a single unit or preferably as two units as shown in FIG. 2, for receiving a conventional nipple cap holder 57 having an internal threaded portion 58.

Threaded extension 56 has an outer circumferential extent 59 substantially equal to the inner circumferential extent of snap receiver 60 on cap 53. The snap receiver 60 includes a recessed portion 61 to receive the extension 62 at the base edge of threaded extension 56. The threaded extension 56 is provided with threads 63 which mate with and screw cap 57 onto threaded extension 56.

Referring more particularly to FIGS. 9–11 which show another embodiment in which like or similar parts to those in FIGS. 1 to 8 are raised by 100, and swivel connector mechanism 120 is shown at the bottom of bellows-type unit 30.

The bellows-type unit 30 is the same as in the FIGS. 1 to 8 embodiment. The roof unit 42 is shown in the same arrangement as in the previous embodiment. However, it is within the scope of the invention to have the bellows-type unit 30 reversed so that the roof portion 42 is reversed and connected with swivel connector mechanism 120. If the roof portion 42 is reversed, then the bellows-type unit 30 would appear reversed with the curvature of the roof facing the bottom of the drawing.

The double-headed arrow 70 indicates that bottle connector or outer cap 157 has an extension 158 swivels relative to swivel element 153. In this embodiment, threaded extension 158 is shown integral with cap 157. Cap 157 has internal threads 156 which are adapted to mate with external threads on the bottle 114. The bellows unit 30 is connected with the outer portion 159 of swivel element 153.

Referring now more particularly to FIG. 12 which shows an alternate connector for connecting the nipple to the bellows unit or the bellows unit to the bottle 14 or 114, a quick lock and disconnect mechanism comprising a cam or lock mechanism 202 or extension and cam and lock mechanism 204 on cap 253 is shown.

Cam and lock mechanism 204 includes camming surfaces 210, 212 and stop element 214 having groove receiving portions 216 and 218 between 210 and 212, and 212 and 214, respectively. Cam and lock mechanism 202 includes tongue member 220, cam surface 222 and cam surface 224. While only one pair of cam and lock mechanism 202 and 204 are described, four are shown, and tongue 220 first rides over camming surface 210 and then on camming surface 212 for seating in groove portion 218. Sealing in groove portion 216 is a partial locking of the two members together.

While there has been shown what is considered to be the preferred embodiments, various changes and modifications may be made thereon without departing from the scope of the invention.

We claim:

1. An adjustable orientation device for a baby bottle to change the angular relationship between an exit area of the bottle and an exit from an exit orifice coupled with the exit area, comprising:

a bellows-type cylindrical structure having an entrance way and an exit way, and a longitudinal axis between said exit way and said entrance way in one condition of said structure when said entrance way and said exit way are axially aligned;

said entrance way including means for connecting said bellows-type structure to an exit opening of the baby bottle;

said exit way including means for connecting said bellows-type structure to a nipple orifice means defining said exit orifice;

said bellows-type structure including:

at least one bellow member and being sufficiently resilient to remain in any one of a plurality of pre-selected positions and being compressible to a minimum length condition and extendable to a maximum length condition and various dimensions between said minimum length and said maximum length; and locking means connected with said at least one bellow member so that said at least one bellow member and said locking means can be locked to each other and when said exit way and said entrance way are no longer axially aligned, and said locking means including an interlocking mechanism having a roof member, and a half bellow member coupled with said at least one bellow member for locking thereof in different angular orientations between said exit way and said entrance way with said at least one bellow member being locked under said roof member, and said at least one bellow member having an outer diametrical extent greater than an outer diametrical extent of said roof member.

2. The device of claim 1, wherein said bellows-type structure includes at least two of said at least one bellow member and is bendable so that the exit way has a longitudinal axis orthogonal to a longitudinal axis of said entrance way and said roof member forms an upper curved roof portion and said half bellow member forms an under-roof member connected at its inner diametrical extent to said at least one bellow member and connected at its outer diametrical extent to the outer diametrical extent of said upper curved roof portion.

3. The device of claim 1, wherein said at least one bellow member includes at least one unitary part having an outer apex formed as a continuous surround member having a major diameter defining said outer diametrical extent and two inner surround members each having a major diameter less than the major diameter of said outer apex, and said roof member includes a curved roof having a partial torroidally-shaped surface connected between said outer apex and said exit way.

4. The device of claim 3, wherein said half bellow member includes an under-roof member which is a substantially planar surface element having one end joining the inner surround member of the said at least one bellow member adjacent thereto and an outer diametrical joining extent connected with an outer diametrical extent of said curved roof.

5. The device of claim 1, wherein said at least one bellow member includes at least one unitary part having an outer apex formed as a continuous surround member having a major diameter defining said outer diametrical extent and two inner surround members each having a major diameter less than the major diameter of said outer apex and two substantially coextensive members each having an outer peripheral end joined with said continuous surround member and an inner peripheral end joined with a respective one of said two inner surround members.

6. The device of claim 5, wherein said bellow-type structure includes at least two of said at least one bellow member and each of said at least one bellow member includes a pair of said two substantially coextensive members each having one end commonly connected with a respective one of said continuous surround members and the other end connected with one of said two inner surround members and joined with a next adjacent bellow member and each pair of said two substantially coextensive members includes an upper and a lower side member which fits underneath said upper side member, said upper and lower side members being of the same configuration and snappably related to each other so that movement of said lower and upper side members together causes said lower side member to snap into and under said upper side member.

7. The device of claim 6, including means coupling said interlocking mechanism to said exit way and means coupling one of said lower side members to said entrance way.

8. The device of claim 6, wherein said lower side member is lockable into place by said interlocking mechanism so that the axis of said exit opening and said inner surround members have their axes intersecting.

9. The device of claim 1, including a swivel connector at at least one of said entrance way and said exit way.

10. The device of claim 1, wherein said connecting means of said exit way includes cam and locking means associated with said bellows-type structure and a nipple connector on said nipple orifice means, said cam and locking means including at least two camming surfaces on each of said bellows-type structure and said nipple connector, and a lock member on each of said bellows-type structure for providing a quick connect and disconnect of said bellows-type structure and said nipple connector.

* * * * *